United States Patent [19]

MacPhee et al.

[11] Patent Number: 4,461,210

[45] Date of Patent: Jul. 24, 1984

[54] WEDGE SHAPED INK AGITATOR FOR PRINTING PRESSES

[75] Inventors: John MacPhee, Rowayton, Conn.; C. Robert Gasparrini, Rye, N.Y.; David Wirth, West Redding, Conn.

[73] Assignee: Baldwin-Gegenheimer Corporation, Stamford, Conn.

[21] Appl. No.: 526,229

[22] Filed: Aug. 25, 1983

Related U.S. Application Data

[63] Continuation of Ser. No. 318,431, Nov. 5, 1981, abandoned.

[51] Int. Cl.[3] ..... B41F 1/40

[52] U.S. Cl. ..... 101/363; 101/364

[58] Field of Search ..... 101/366, 363, 364, 350, 101/204, 207, 208, 210, 355, 356, 360

[56] References Cited

U.S. PATENT DOCUMENTS

| | | | |
|---|---|---|---|
| 1,778,600 | 10/1930 | Jones | 101/364 |
| 1,835,321 | 12/1931 | Ortles | 101/364 |
| 3,000,300 | 9/1961 | Ortles | 101/364 |
| 3,173,363 | 3/1965 | Martin | 101/364 |
| 3,848,529 | 11/1974 | Gegenheimer et al. | 101/363 |

*Primary Examiner*—Edward M. Coven

[57] ABSTRACT

A non-rotating wedge-shaped ink agitator which reciprocates within an ink fountain along the length of an ink fountain roller. The ink agitator has a substantially flat bottom surface, side surfaces extending upwardly and outwardly from the bottom surface and a top surface which slopes toward the end of the agitator adjacent the ink fountain roller.

12 Claims, 18 Drawing Figures

FIG. 5
PRIOR ART
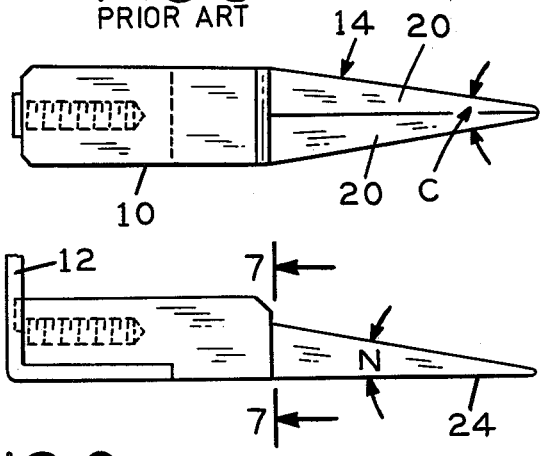
FIG. 7
PRIOR ART
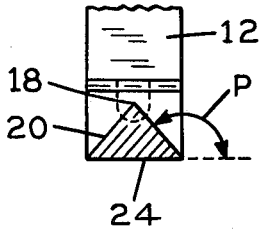
FIG. 6
PRIOR ART
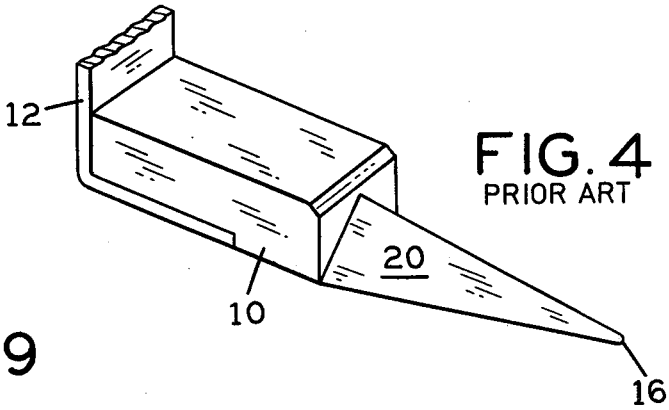
FIG. 4
PRIOR ART
FIG. 9
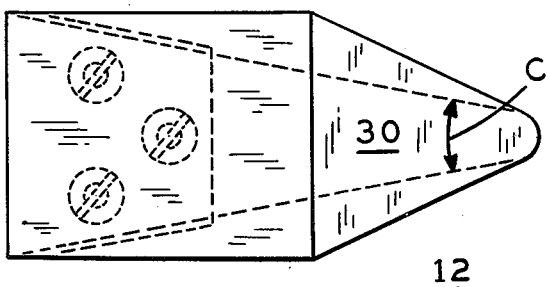
FIG. 8
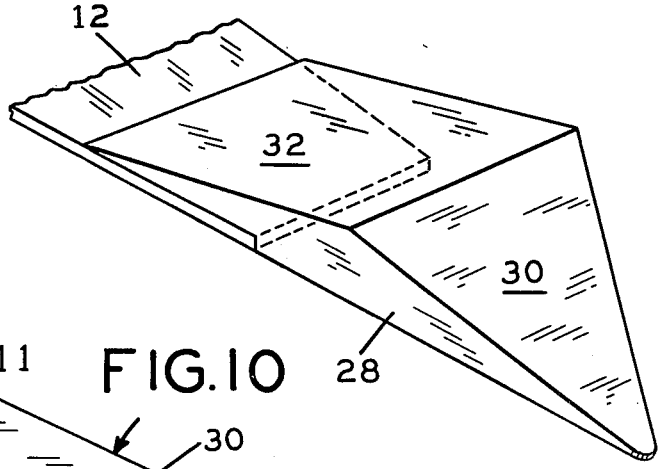
FIG. 11
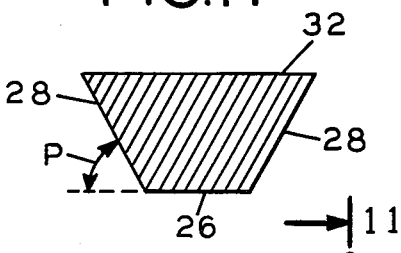
FIG. 10
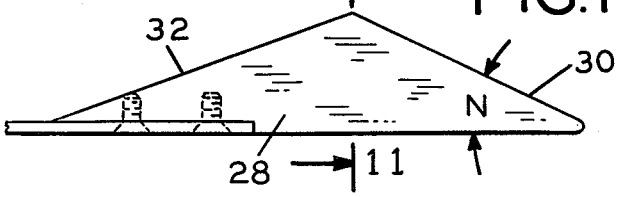

THIS FORM USED ON 12-3/8 INCH BY 18-1/2 INCH SHEETS RUN IN TESTS OF IMPROVED DESIGN ON GTO PRESS. SHADED AREAS REPRESENT SOLID INK COVERAGE. INK COVERAGE WAS 54 SQUARE INCHES OR 24 PERCENT OF PRINTING AREA.

WEDGE SHAPED INK AGITATOR FOR PRINTING PRESSES

This is a continuation, of application Ser. No. 318,431 filed Nov. 5, 1981, abandoned.

BACKGROUND OF INVENTION

This invention relates to an ink agitator and more particularly to a non-rotating wedge shaped ink agitator.

In printing presses it is customary to form an ink fountain or reservoir between the fountain roller and the ink fountain blade. There is a metering nip or gap between the ink fountain blade and the ink fountain roller which controls the amount of ink metered onto the ink fountain roller.

It is customary to provide in the ink fountain an ink agitator which mixes the ink within the ink fountain and helps insure an even distribution of the ink within the ink fountain. Traditionally, the major use of ink agitators has been for sheetfed printing presses rather than for web presses. This is because, generally speaking, sheetfed presses use inks which are more viscous the web presses. The more fluid ink used in web presses did not demand the use of ink agitators. In addition, where web pressures were hand fed, ink agitators were not favored since they required periodic cleaning requiring an additional difficult and time consuming maintenance task.

Recently there has been an increase in the use of web presses and the use of ink agitators has increased substantially because of the trend towards stiffer and/or more viscous ink.

Similarly, more and more sheetfed printers have been equipping their presses with ink agitators. Accordingly, there has been an increase in demand for ink agitators.

There are five reasons why agitators are used.

1. To prevent ink skinning.
2. To maintain an adequate supply of ink to the metering nip.
3. To maintain a uniform distribution of ink along the length of the fountain.
4. To work the ink so as to improve its flow characteristics on the rollers.
5. To mix the ink contained in the fountain.

Ink skinning refers to the formation of a partially dried film or skin on the surface of the ink. Although this occurs much more rapidly on sheetfed presses, where inks used dry by oxidation, the problem also exists on commercial web presses which utilize heatset inks. Aside from resulting in ink waste, skinning is undesirable because the skin can break up and generate hickeys, which in turn can result in significant paper waste and loss of productivity. A properly designed ink agitator eliminates skinning by continually stirring the ink and creating new surface without a skin.

Proper operation of an ink fountain requires that an adequate supply of ink be fed to the metering nip. However, the ink has a tendency to back away or hang back from the fountain roller and form a crevice adjacent the roller. This eventually may result in lack of ink at the nip even though there may be sufficient ink remaining in the fountain. A properly designed ink agitator will maintain the ink in contact with the ink fountain roller.

An ink agitator can also help prevent starvation of the metering nip in areas of heavy ink coverage which can adversely reduce print density. When the ink is not free to flow along the length of the fountain, there can occur ink shortages in areas where more ink is used particularly where less fluid inks are used. A poorly designed ink agitator will push or plow ink towards the ends of the fountain thus aggravating the problem.

The fourth reason for using an ink agitator is because it results in working of the ink contained in the fountain, thereby reducing the tack of the ink transferred to the ink rollers. Although the actual working of the ink is effected by the fountain roller rather than the agitator, the agitator makes this possible by constantly pushing the ink into contact with the roller.

Another reason for using an ink agitator is its mixing ability which prevents sudden changes in the composition of the ink fed to the metering nip which could cause sudden and drastic changes in print density. Sudden changes in the ink composition can occur because of fresh ink added to the ink fountain to compensate for consumption; paper lint, emulsified ink, or ink bleed from previous down colors, all which may be carried into the fountain by the ink which is fed back from the roller train.

The prior art teaches a variety of different types of ink agitator devices. One commonly used design consisted of one or more narrow blade-type fingers located close to the fountain blade normal to the roller. The fingers reciprocate parallel to the axis of the roller. In addition, other agitator structures have been tried including a plow-shaped traversing finger, and vertical rods designed to longitudinally slice the ink wave generated by the conventional blade-type finger. Another agitator utilized two oscillating arms, placed in the bottom of a box-type fountain.

None of these proposals were completely satisfactory in that they were difficult to clean and sometimes caused plowing of the ink to either end of the fountain. More recently, a pyramid shaped traversing member has been used with some success on small duplicator-type presses.

The most commonly used ink agitator utilizes a rotating conical shaped member which is positioned in the ink fountain substantially normal to the fountain roller, with less than 1/16 inch clearance between it and the fountain blade. The cone is attached to an actuator which causes the cone to traverse back and forth along the length of the fountain. As it traverses back and forth, the cone also rotates in an anti-rolling direction. In other words, the cone shaped agitator is rotated in the opposite direction than it would rotate if it were freely mounted. This anti-rolling motion is very important, since it prevents plowing of ink to either end of the fountain. If the cone is not caused to rotate in the anti-rolling direction, ink will be plowed or pushed along to the ends of the ink fountain. Plowing is generally defined as pushing or displacing ink to the ends of the ink fountain. This is undesirable because it can result in premature starvation of the metering nip in the center of the ink fountain. In addition, as a result of the plowing, some ink will also climb or be pushed back up the fountain blade, resulting in a higher ink shoreline. Plowing can also result in overflowing of ink at the ends of the fountain.

The cone-type agitator is described in more detail in U.S. Pat. No. 3,848,529 issued Nov. 19, 1974 to H. W. Gegenheimer and U.S. Pat. No. 3,084,025 issued Apr. 9, 1963 to H. W. Gegenheimer. Although the cone shaped ink agitator has proven to be an invaluable accessory on offset lithographic presses, the need to provide the cone with a rotary motion has proven to be an encumbrance. This leads to two disadvantages when used on certain types of presses.

The first of these disadvantages results from the location or placement of the agitator housing body, which houses the traversing mechanism, which is limited by the requirement of imparting a rotary motion to the cone.

The main element of the agitator traversing mechanism consists of a U-shaped section body, mounted parallel to the fountain roller. The body contains rails which retain and guide the cone carriage. An endless chain, driven by an electric motor, causes the carriage to traverse back and forth along the agitator body. The agitator cone is mounted on a shaft which is retained by bearings in the carriage. A gear fastened to the shaft engages a stationary rack mounted within the body. Thus, when the carriage is caused to move by the endless chain, the cone is rotated by the action of the gear rolling along the rack. Although this design is functionally satisfactory, it allows little flexibility in locating the agitator body. In order to provide greater flexibility in agitator body placement several different indirect cone driven arrangements have been attempted.

However, all of the agitator structures have one feature in common; namely, the U-shaped section body is mounted on its side so that the opening in the body faces the fountain.

This arrangement poses a problem on web presses in that the traversing mechanism is exposed to contamination and fouling by ink spillage during both hand feeding and cleaning of the fountain.

The second drawback of the rotary cone design stems from the fact that, even with various design variations, it is not always possible to mount the ink agitator in a location on a press that does not obstruct access to the ink fountain or get in the way of the pressman. This problem is especially acute on both the lower printing units of many web presses and many common impression sheetfed presses.

In addition to the foregoing the cone shaped, traversing, rotating ink agitator cone requires, as indicated above, a relatively large number of parts. Thus the manufacture of such an ink agitator can be expensive. It is also difficult and time consuming to clean in the event it becomes encrusted with ink.

Web presses operate at high speeds and as a result utilize larger than normal amounts of ink and the pressman is constantly replenishing the ink supply with the result that a sloppy pressman can spill ink into the ink agitator's inner workings.

OBJECTS OF THE INVENTION

With the foregoing in mind, it is an object of this invention to provide a new and improved ink agitator for use in an ink fountain.

Another object of this invention is to provide a new and improved non-rotating ink agitator.

A further object of the invention is to provide a new and improved non-rotating ink agitator which prevents plowing and provides for effective mixing of ink in an ink fountain.

A still further object of this invention is to provide a non-rotating ink agitator which is substantially wedge-shaped and reciprocates in an ink fountain so as to mix ink, distribute ink evenly with respect to the ink fountain and prevent plowing.

Another object of this invention is to provide a new and improved ink agitator which is simple in construction and has a reduced manufacturing cost.

A further object of this invention is to provide a non-rotating wedge shaped ink agitator which is simple in construction.

Additional objects and advantages of the invention will be set forth in the description which follows and in part, will be obvious from the description, the objects and advantages being realized and obtained by means of the parts, instrumentation, methods, apparatus and procedures particularly pointed out in the appended claims.

BRIEF DESCRIPTION OF THE INVENTION

Briefly described, the present invention relates to a non-rotating wedge shaped ink agitator which traverses back and forth in the ink fountain. The wedge shaped agitator is moved back and forth in the ink fountain by means of an endless chain, as is known in the art or by any other known means.

The main purpose of the generally wedge-shaped agitator is to push the ink against the fountain roller, i.e., cause feeding of the nip, even though there is a natural tendency of the ink to back away from the ink roller. In addition, the ink agitator causes a rolling action by generating a wave of ink which causes turbulence and mixing of the ink. At the same time, the agitator must not produce plowing, i.e., causing ink to be removed from the center of the ink fountain and deposited at the ends thereof.

The ink agitator of this invention which accomplishes the foregoing results is non-rotating and slides along the ink fountain blade the longitudinal length of the ink fountain adjacent the ink fountain roller. The bottom surface of the wedge shaped agitator is substantially flat which permits the agitator to slide in close proximity along the bottom surface of the ink fountain which is the ink fountain blade. The wedge shaped agitator extends into the ink fountain and terminates a short distance from the ink fountain roller. The narrowest portion of the wedge is adjacent the ink fountain roller. The ink agitator has a shape in vertical cross section which is generally an inverted trapezoid where the non-parallel sides are equal in length. The size of the trapezoid decreases as the cross section is taken closer to the tip or apex of the ink agitator.

There are several important angles in the construction of the wedge shaped ink agitator. There are the nose angle, the plow angle and the cone angle. By proper control and interrelation of these angles the wedge shaped non-rotating ink agitator achieves its desired results.

The invention consists of the novel parts, steps, constructions and improvements shown and described.

The accompanying drawings which are incorporated in and constitute part of this specification illustrate embodiments of the invention and, together with the description, serve to explain the principles of the invention.

FIGS. 4–7 relate to the prior art.

FIG. 4 is a perspective view of one version of the prior art.

FIG. 5 is a plan view of the device shown in FIG. 4.

FIG. 6 is a side elevation view of the device shown in FIG. 4.

FIG. 7 is a vertical section taken along line 7—7 of FIG. 6.

FIG. 8 is a perspective view of an embodiment of the invention.

FIG. 9 is a plan view of the embodiment shown in FIG. 8.

FIG. 10 is a side elevation view of the embodiment shown in FIG. 8.

FIG. 11 is a vertical section taken along line 11—11 of FIG. 10.

Figure 12:
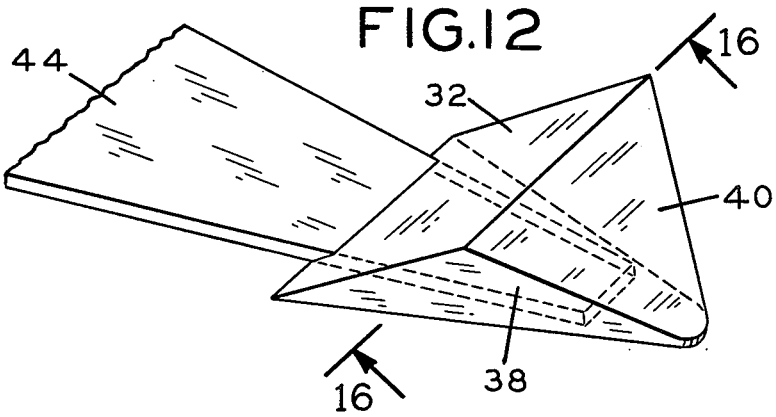

FIG. 12 is a perspective view showing a preferred embodiment of the invention.

Figure 13:
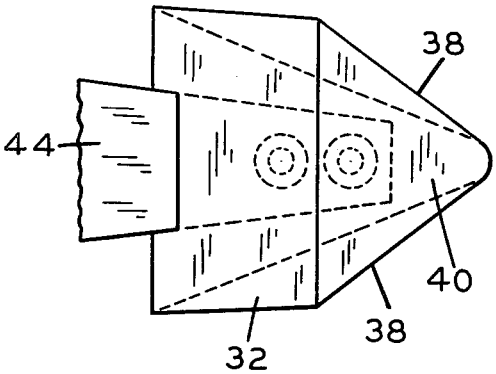

FIG. 13 is a plan view of the embodiment shown in FIG. 12.

Figure 14:
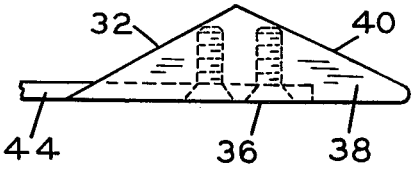

FIG. 14 is a side elevation view of the embodiment shown in FIG. 12.

Figure 15:
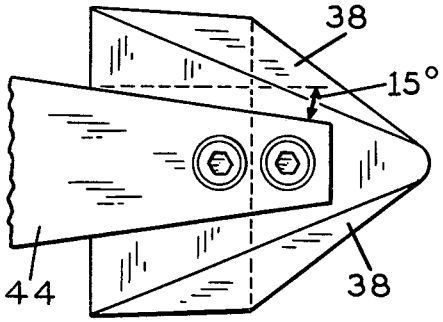

FIG. 15 is an underside plan view of the device shown in FIG. 12.

Figure 16:
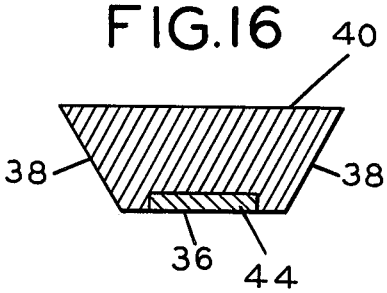

FIG. 16 is a vertical section view taken along line 16—16 of FIG. 12.

Figure 17:
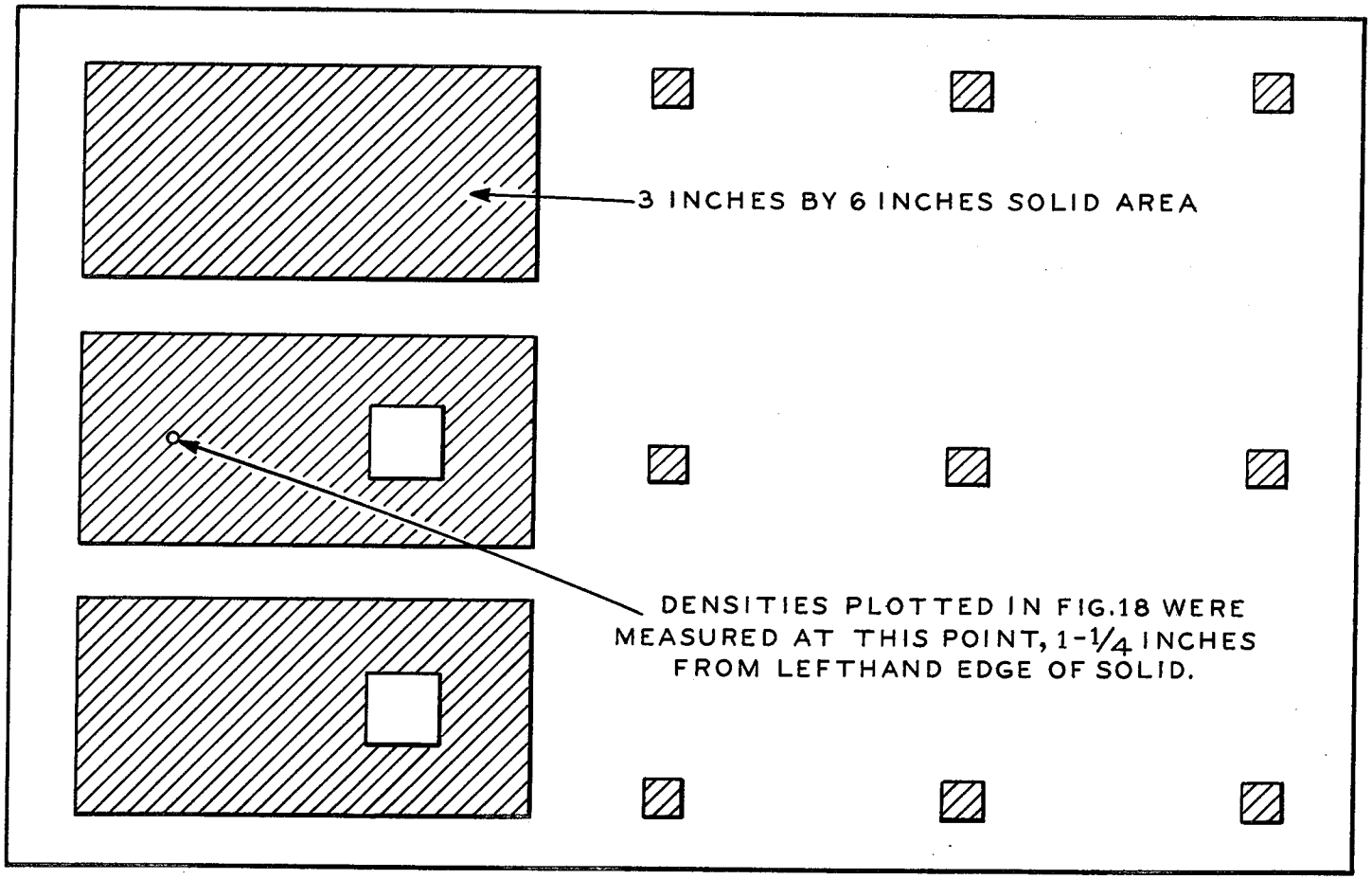

FIG. 17 is an illustration of a chart used to test ink densities after a period of use.

Figure 18:
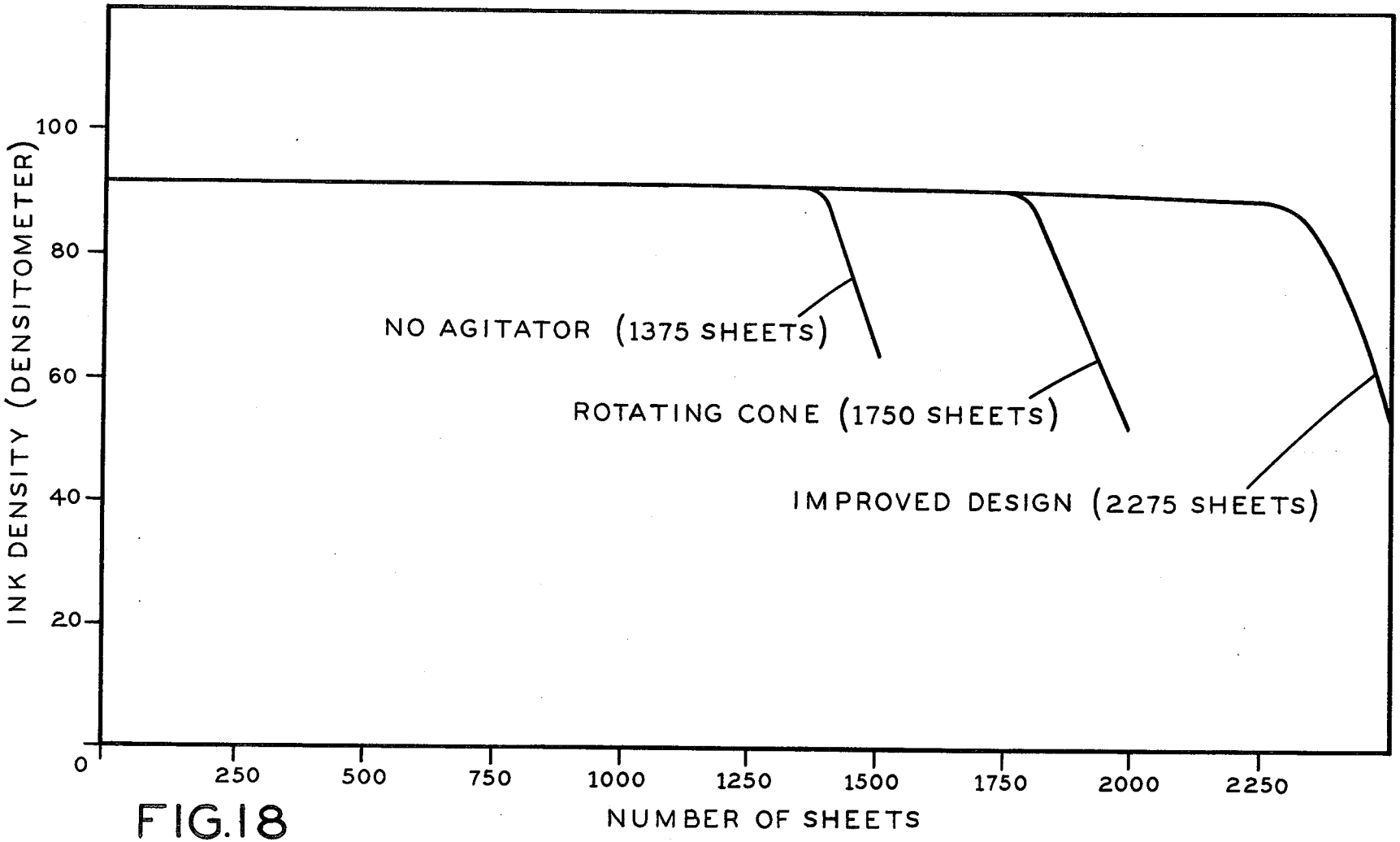

FIG. 18 is a comparison chart showing one of the advantages of the invention.

Figure 1:
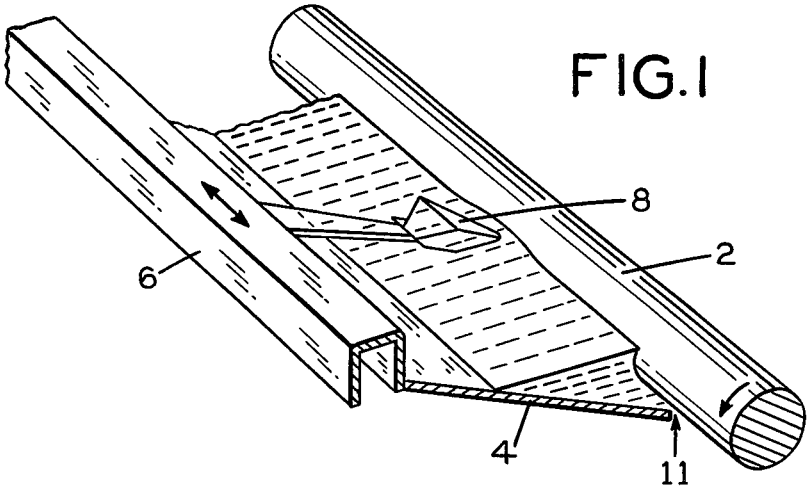
FIG. 1 is a perspective view showing the ink agitator of the present invention within an ink fountain adjacent an ink fountain roller.

Referring to FIG. 1, the general environment of the invention is shown. As illustrated therein, there is shown a typical ink fountain roller 2 and ink fountain blade 4, a housing 6, and an ink agitator 8. The ink fountain blade 4 is positioned with respect to the ink fountain roller so as to form an ink metering gap 11. The ink fountain roller 2, ink fountain blade 4 and sides (not shown) form an ink fountain having a quantity of ink therein.

Figure 2:
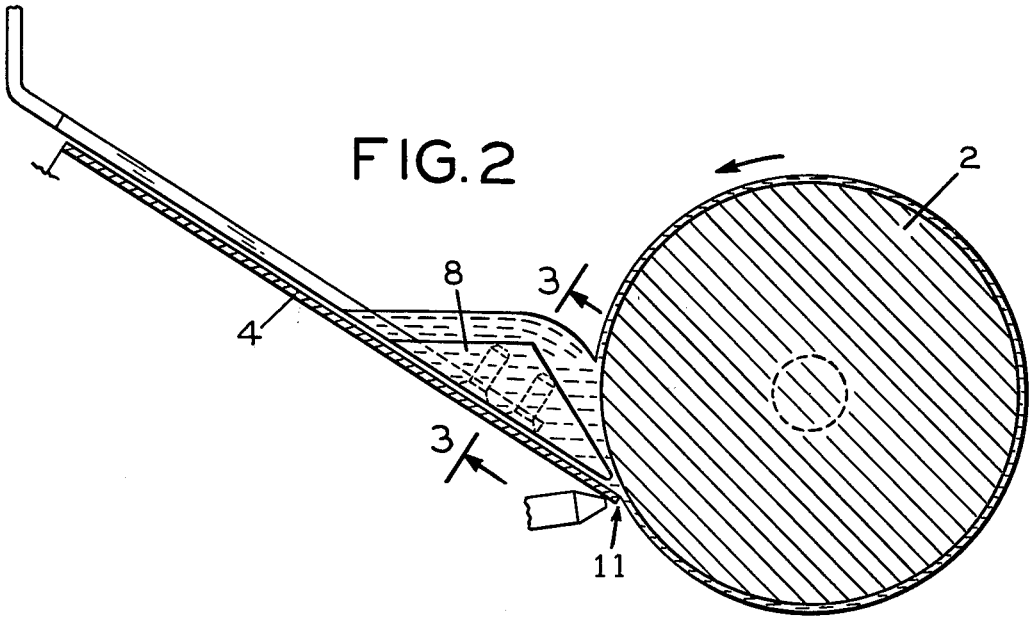
FIG. 2 is a transverse section of FIG. 1.
Figure 3:
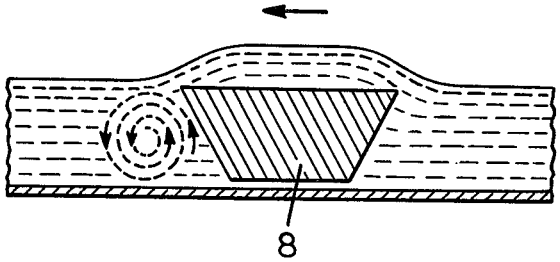
FIG. 3 is a vertical section taken along line 3—3 of FIG. 2.

As is the usual case, and shown in FIG. 2, the ink agitator is mounted adjacent the ink fountain and extends into the fountain to a terminal position adjacent the ink fountain roller 2. The ink agitator is reciprocated back and forth by conventional means not shown in the ink fountain from one end of the ink fountain to the other and from one end of the ink fountain roller to the other. As can be seen in FIG. 2, the ink tends to form a valley adjacent the ink fountain. FIG. 3 shows the direction of the wave formed which causes the mixing of the ink. (See arrows)

As stated hereinbefore one known form of ink agitator is a cone shaped agitator which traverses the ink fountain while being rotated in a direction opposite from the rolling direction, i.e., opposite from the direction of a free-wheeling agitator was reciprocated in the ink fountain. This form of agitator has been very satisfactory from a functional standpoint, but as indicated above, may become contaminated with ink which causes sticking and prevents the mechanism from functioning.

In an effort to avoid the problem involved with the mechanism sticking where a rotating cone is used an effort has been made to develop a non-rotating ink agitator. This structural arrangement is shown in FIGS. 4–7.

As shown in FIGS. 4–7 the non-rotating ink agitator includes a base 10 having a base plate 12. The base plate 12 is adapted to be connected to a suitable housing which can cause reciprocation of the base plate 12 and its associated structure. Extending from the base 10 is a pyramid like structure 14. The pyramid 14 is wide adjacent the base 10 and tapers uniformly to a point 16 at its terminal end which is normally positioned adjacent the ink roller 2.

When viewed in cross section (FIG. 7) the wedge-shaped portion is generally triangular in shape. The pyramid shaped element 14 has an apex 18 and two sloping sides 20.

It has been found that in the non-rotating ink agitators there are several significant angles certain of which have been found to be critical at least for certain situations.

Cone Angle—The angle formed between the terminal ends of the sloping sides 20 designated C in FIG. 5.

Plow Angle—The angle between the sloping sides and the base. This is, in essence, the angle of the sides 20 which come into contact with te ink. The plow angle is designated P in FIG. 7.

Nose Angle—The angle of slope of the apex 18 from the base 24 shown as N in the drawings FIG. 6.

There are several criteria which are used to determine the effectiveness of an ink agitator.

Ink Mixing: The ability to mix ink in he ink fountain. This has been measured by the number of traverses of the ink agitator required to mix a known amount of yellow ink into a known amount of varnish so that the two are blended.

Longitudinal Distribution—The ability of the ink agitator to distribute ink evenly along the ink fountain nip.

Nip Feeding—The ability of the ink agitator to position ink adjacent the ink fountain roller so as to feed ink to the ink fountain nip.

Prevention of Skinning—The ability of the ink agitator to prevent the formation of a skin or crust of ink in the ink fountain.

Plowing or Absence of Plowing—The ability of the ink agitator to prevent ink from being deposited or plowed to either end of the ink fountain.

Table I is a comparison between various ink agitator constructions.

The standard rotating agitator is the type ink agitator described in the aforementioned patents which rotates in the nonrolling direction.

The reverse rotating agitator has a construction similar to the standard rotating agitator except that it rotates in the opposite, i.e., rolling direction.

The ink agitator designated as the pyramid type is illustrated in FIGS. 4–7 hereof.

The agitator designated as the improved non-rotating agitator is an ink agitator in accordance with this invention.

As can be seen from Table I, the agitator in accordance with the present invention produced the best overall results.

TABLE I

Results of Tests Run to Evaluate Performance of Improved Cone

| Type of Agitator | Agitator Performance Parameter: Mixing | Longitudinal Distribution | Feeding | Absence of Plowing |
|---|---|---|---|---|
| Standard Rotating | Poor 75 cycles | Fair | Good | Excellent |
| Reverse Rotating | Excellent 30 cycles | Not Tested | Poor | Poor |
| Pyramid | Poor 80 cycles | Not Tested | Not Tested | Good |

TABLE I-continued

| Type of Agitator | Results of Tests Run to Evaluate Performance of Improved Cone — Agitator Performance Parameter: Mixing | Longitudinal Distribution | Feeding | Absence of Plowing |
|---|---|---|---|---|
| Improved Non-rotating | Excellent 35 cycles | Excellent | Excellent | Good |

Referring to FIGS. 8–11, there is shown one embodiment of the present invention. As shown therein, there is a non-rotating ink agitator having a substantially flat base 26, sides 28 which slope upwardly and outwardly from the flat base and a top surface 30 which slopes towards the end of the agitator. There is a rear surface 32.

As shown in FIGS. 9–11 there is a plow angle P which is less than 90 degrees, a cone angle C, and a nose angle N. It will be noted from FIG. 11 that the cross section of the ink agitator is in the form of an inverted isosceles trapezoid with the plow angles being equal.

In order to determine the preferred cone angle and plow angle, a series of tests were run using a plow angle varying from 45 to 135 degrees and a cone angle varying from 0 to 90 degrees. The results are set forth in Table 11 where the following results ae set forth:

1. Plowing, 2. Rolling (mixing), 3. Feeding, 4. Subjective evaluation of overall performance.

As a result of these tests, it has been found that the plow angle should be less than 90 degrees and in the range of 45 to 90 degrees. The cone angle should be in the range of 15–45 degrees. In a preferred embodiment the plow angle is about 60 degrees and the cone angle is about 45 degrees.

While the nose angle is not as critical, it has been found that a nose angle of about 30 degrees gives satisfactory results.

Referring to FIG. 3, an ink agitator of the present invention is shown in functional position. As can be seen, the ink agitator caused a rolling action of the ink in the general form of a wave as shown by the arrows. The wave of ink causes a thorough and complete mixing of the ink.

In certain installations and under certain conditions it has been found that there can be a problem of "climbing". Climbing consists of the shore line of ink in the ink fountain rising or moving upwardly from the ink fountain roller.

Climbing, if allowed to continue, could result in ink spillage. In any event, excessive climbing can cause problems regarding formation of skin in the ink fountain.

FIGS. 12–16 illustrate a preferred embodiment of the invention which provides a proposed solution to the problem of climbing. This embodiment is similar to the embodiment in FIGS. 8–11. The embodiment includes a base 36, sloping side walls 38, a sloping top surface 40

TABLE II

Summary of Screening Tests Run to Explore Effect of Cone and Plow Angles

| CONE ANGLE (As defined in FIG. 5) | PLOW ANGLE (As defined in FIG. 7): 45° | 60° | 75° | 90° | 105° | 120° | 135° |
|---|---|---|---|---|---|---|---|
| 0° | Test #5<br>1 Excessive plowing<br>2 Good rolling<br>3 Poor feed<br>4 Unacceptable | Test #4<br>1 Excessive plowing<br>2 Good rolling<br>3 Poor feed<br>4 Unacceptable | Test #3<br>1 Excessive plowing<br>2 Good roll.<br>3 Poor feed<br>4 Unacceptable | Test #2<br>1 Excessive plowing<br>2 Good rolling<br>3 Poor feed<br>4 Unacceptable | | | |
| 10° | | Test #8<br>1 Mild plowing<br>2 Good roll.<br>3 Fair feed<br>4 Marginal | | Test #6<br>1 Mild plowing<br>2 Good rolling<br>3 Fair feed<br>4 Marginal | | Test #16<br>1 Little plow.<br>2 Fair rolling<br>3 Good feed<br>4 Acceptable | |
| 20° | Test #11<br>1 Mild plow.<br>2 Excellent rolling<br>3 Good feed<br>4 Marginal | Test #12<br>1 Little plow.<br>2 Excellent rolling<br>3 Good feed<br>4 Acceptable | Test #13<br>1 Little plow.<br>2 Excellent rolling<br>3 Good feed<br>4 Acceptable | Test #7<br>1 Mild plowing<br>2 Good rolling<br>3 Good feed<br>4 Acceptable | Test #17<br>1 Little plow.<br>2 Good rolling<br>3 Excel. feed<br>4 Acceptable | Test #15<br>1 Little plow.<br>2 Poor rolling<br>3 Excel. feed<br>4 Marginal | Test #14<br>1 Little plowing<br>2 Poor rolling<br>3 Excel. feed<br>4 Unacceptable |
| 30° | | Test #21<br>1 Mild plowing<br>2 Good rolling<br>3 Good feed<br>4 Marginal | | Test #8<br>1 Mild plowing<br>2 Good rolling<br>3 Good feed<br>4 Acceptable | | | |
| 60° | | | | Test #9<br>1 Mild plowing<br>2 Poor rolling<br>3 Excellent feed<br>4 Marginal | | | |
| 90° | | | | Test #10<br>1 Mild plowing<br>2 Poor rolling<br>3 Excellent feed<br>4 Unacceptable | | | |

and a rear wall 32 all of which are found in the embodiment of FIGS. 8–11. The structural member 44 which connects the wedge-shaped agitator with the agitator carriage is made of a relatively thin, wedge shaped piece of material. In the preferred embodiment, the included angle of the wedge shaped support member is about 15 degrees (FIG. 15).

It has been found that this support being angled as shown, rather than straight, prevents climbing.

In the embodiment of the agitator, it has been found important to control the cross-sectional area in order to prevent plowing. It has been found that the cross-sectional area in the plane normal to the fountain roller axis of the wedge-shaped agitator engaging the ink should be in the range of 1/6 to 1/9 the cross-sectional area of ink in a fully filled ink fountain. The preferred ratio is that the cross-sectional area of the agitator should be 1/8 the area of the ink contained in a fully filled ink fountain. The two examples, discussed below, illustrate the advantages of the present invention.

EXAMPLE 1

A series of tests were run to measure the relative performance of a conventional rotating cone-type agitator, a pyramid-type, as shown in FIGS. 5, 6, and 7, and the improved design, shown in FIGS. 12 through 16. These tests were carried out in a typical ink fountain, which was 48 inches long. At the start of each test, temporary dividers were placed in the fountain so as to form 3 separate reservoirs. The middle reservoir was centrally located and measured 11 inches long while the two outer reservoirs each measured approximately 18 inches. The central section was filled with heat-set yellow ink, No. 76C870, manufactured by Inmont Corporation. The two end reservoirs were filled with varnish, No. OP KJ255, also supplied by Inmont Corporation. In general, 2 types of tests were run: high-level and low-level. In the high-level tests, the equivalent of 5 pounds of ink was placed in the full fountain length while in the low-level tests the equivalent amount of ink was about 2 pounds.

The test procedure involved removing the temporary dividers, and starting both the ink agitator and the roller ratcheting mechanism at the same time. The plowing performance of the agitator was observed subjectively while the number of agitator traverses was recorded for various conditions of mixing. In the case of the improved design, 3 different sizes were tried. These sizes were identified as the ratio of the cross-sectional area of ink contained in a fully filled fountain to the cross-sectional area of the agitator.

The results of these tests, summarized in Table 2, show that the improved design of the third embodiment (60 degree plow angle, 45 degree cone angle, 25 degree nose angle, and 8 to 1 area ratio) has a greatly improved mixing performance at low ink fountain levels. This is particularly important since this indicates good mixing of the ink being fed to the fountain metering gap. At high ink levels, the mixing performance of the improved design is also superior to the rotating cone and about equivalent to the pyramid geometry. Finally, the test results show that the plowing performance of the improved design is quite sensitive to the sizing. That is, if the improved design size is made too large (e.g., 6 to 1), the plowing performance of the improved design is fair to poor. However, when properly sized (i.e., 8 to 1), the plowing performance of the improved design is good to excellent.

Silent refers to a fountain roller not moving while indexing refers to the fountain roller being indexed, i.e., partly rotated a certain amount.

TABLE II

| | TEST RESULTS - EXAMPLE 1 | | | |
|---|---|---|---|---|
| | FOUNTAIN ROLLER | | | |
| | SILENT | | INDEXING ½" | |
| | MIXING | PLOWING | MIXING | PLOWING |
| | HIGH INK LEVEL | | | |
| ROTATING CONE 150"/MIN. | 40% MIXED AT 50 CYCLES | EXCELLENT | 90% MIXED AT 40 CYCLES* 100% AT 70 CYCLES | EXCELLENT |
| PYRAMID AT 150"/MIN. | 85% MIXED AT 50 CYCLES" 100% AT 80 CYCLES | GOOD/ EXCELLENT | MIXED AT 30 CYCLES | GOOD/ EXCELLENT |
| IMPROVED DESIGN 45° 6:1 150"/MIN. | 95% MIXED" AT 50 CYCLES | POOR/FAIR | — | — |
| IMPROVED DESIGN 45° 7:1 150"/MIN. | 90% MIXED AT 50 CYCLES* | FAIR/GOOD | — | — |
| IMPROVED DESIGN 45° 8:1 150"/MIN. | 75% MIXED AT 50 CYCLES" | GOOD/ EXCELLENT | 95% MIXED AT 40 CYCLES" 100% MIXED AT 150 CYLCLES | GOOD/ EXCELLENT |
| | LOW INK LEVEL | | | |
| ROTATING CONE 150"/MIN. | 90% MIXED AT 270 CYCLES | EXCELLENT | MIXED AT 110 CYCLES | EXCELLENT |
| PYRAMID AT 150"/MIN. | 90% MIXED AT 230 CYCLES | GOOD/ EXCELLENT | MIXED AT 70 CYCLES | GOOD/ EXCELLENT |
| IMPROVED DESIGN 45° 6:1 150"/MIN. | — | — | — | — |
| IMPROVED DESIGN 45° 7:1 150"/MIN. | — | — | — | — |
| IMPROVED DESIGN | MIXED AT | GOOD/ | MIXED AT | GOOD/ |

TABLE II-continued

| TEST RESULTS - EXAMPLE 1 | | | | |
|---|---|---|---|---|
| | FOUNTAIN ROLLER | | | |
| | SILENT | | INDEXING ½" | |
| | MIXING | PLOWING | MIXING | PLOWING |
| 45° 8:1 150"/MIN. | 110 CYCLES | EXCELLENT | 40 CYCLES | EXCELLENT |

*This data is significant because the ink adjacent to the metering nip was completely mixed; thus ink metered onto the fountain roller was 100% mixed. Unmixed ink was located along the back edge of the ink volume, i.e., away from the nip.

EXAMPLE 2

In order to evaluate the performance of the improved design, relative to a conventional rotating cone and no agitator, a series of tests was carried out on a Model GTO Heidelberg press. The overall concept of these tests was to place a predetermined amount of ink in the press fountain and to print, using the form shown in FIG. 17, until good sheets were no longer obtained due to local starvation of the ink fountain nip. The number of good sheets which could be so obtained and the amount of ink remaining in the fountain provided a measure of lateral ink distribution in the fountain. The procedure followed was to carry out the press make-ready operation until satisfactory sheets were obtained. The press was then shut down, and all of the ink in the fountain was removed. Next, 3 ounces of ink was weighed out and placed in the fountain. The pressman was instructed to use his ink knife to distribute this initial ink filling as uniformly as possible over the 18 inch length of the fountain. The counter on the press was reset to 0 and the press was started. Print density and the ink level in the fountain were monitored to detect the onst of ink fountain starvation. Approximately 200 sheets were run beyond that point and the press was then shut down. Density readings were taken and plotted as in FIG. 18 which shows that the cone-type design is significantly better than no agitator while the improved design represents a significant improvement over both. Specifically, 2,275 good sheets could be printed with the improved design in use as opposed to 1,750 good sheets with the rotating cone-type and 1,375 good sheets when no agitator was used. The relative performance of the different agitator designs was also measured by the fact that, with the improved design, 85% of the ink was consumed (0.45 ounces remained in the fountain) as opposed to 68% for the rotating cone (0.97 ounces remaining) and only 55% for the case of no agitator (1.34 ounces remaining).

FIG. 18 shows the results. Printing tests run with 3 ounces of ink in fountain at start of test. With no agitator fountain nip starvation occurred after 1375 sheets were printed and 1.34 ounces of ink remained in fountain. With improved design agitator installed, nip starvation did not occur until 2275 sheets had been run and all but 0.45 ounces of ink had been consumed. Results of similar test with cone-type agitator were 1750 good sheets with 0.97 ounces of ink remaining. Tests were done on Heidelberg GTO press, run at 6500 iph, using process yellow ink on 80 pound coated stock.

What is claimed is:

1. A non-rotating one-piece ink agitator for use in an ink fountain having an ink fountain blade with a substantially flat upper surface and an ink fountain roller, said ink agitator being adapted to be reciprocated back and forth in the ink fountain along the length of the ink fountain roller comprising:

(a) a substantially flat bottom base surface in close proximity to the upper surface of the ink fountain blade; said base surface being relatively wide at one end and narrowing to a relatively narrow portion adjacent the ink roller;

(b) a pair of side surfaces extending upwardly and outwardly from said bottom surface thereby forming a plow angle between the bottom surface and said side surfaces;

(c) a top surface extending between the edges of said side surfaces;

(d) said bottom surface, said side surfaces and said top surface forming an isosceles trapezoid when viewed in vertical section and having an area which is smallest adjacent the ink roller and gradually increases as the vertical section is taken in planes spaced from the ink roller, and (e) said side surfaces being tapered towards the ink roller thereby forming a cone angle.

2. A non-rotating ink agitator as defined in claim 1 where said plow angle is an acute angle.

3. A non-rotating ink agitator as defined in claim 2 wherein said acute angle is in the range of 45° to 90°.

4. An ink agitator as defined in claim 3 wherein said cone angle is in the range of 15–45 degrees.

5. An ink agitator as defined in claim 4 wherein said cone angle is about 45 degrees.

6. An ink agitator as defined in claim 4 wherein said plow angle is about 60 degrees.

7. An ink agitator as defined in claim 2 wherein the cross-sectional area of said agitator is in the range of 1/6 to 1/9 of the cross-sectional area of a fully filled ink fountain.

8. An ink agitator as defined in claim 2 where the cross-sectional area of said agitator is ⅛ of the cross-sectional area of a fully filled ink fountain.

9. An ink agitator as defined in claim 2 having a wedge-shaped support member attached to the said agitator.

10. An ink agitator as defined in claim 9 wherein the included angle of said wedge shaped support member is about 15°.

11. An ink agitator as defined in claim 2 having means for preventing ink climbing in the ink fountain.

12. An ink agitator as defined in claim 11 wherein said means including (a) said wedge shaped supporting member being connected to said bottom surface of said agitator.

* * * * *